United States Patent [19]

Wright

[11] Patent Number: 4,524,479

[45] Date of Patent: Jun. 25, 1985

[54] REPLACEABLE PLASTIC MOPHEAD

[75] Inventor: Paul O. Wright, Schenectady, N.Y.

[73] Assignee: White Mop Wringer Company, Fultonville, N.Y.

[21] Appl. No.: 546,722

[22] Filed: Oct. 28, 1983

[51] Int. Cl.[3] ..... A47L 13/24

[52] U.S. Cl. ..... 15/147 R; 15/150; 15/229 A

[58] Field of Search ..... 15/147 R, 147 A, 147 C, 15/149–153, 229 R, 229 A, 229 B

[56] References Cited

U.S. PATENT DOCUMENTS

| | | | |
|---|---|---|---|
| 512,543 | 1/1894 | Froberg | 15/150 |
| 659,918 | 10/1900 | Froberg | 15/150 |
| 1,385,427 | 7/1921 | Couch | 15/152 |
| 1,701,167 | 2/1929 | Toplitz . | |
| 2,159,350 | 5/1939 | Bundenthal | 15/147 |
| 2,492,232 | 12/1949 | Martin | 15/229 |
| 2,832,089 | 4/1958 | Schwartz et al. | 15/229 |
| 2,902,704 | 9/1959 | Schwartz | 15/229 |
| 3,081,474 | 3/1963 | Modrak | 15/229 |
| 3,328,822 | 7/1967 | Sellesi | 15/229 A |
| 3,447,183 | 6/1969 | McClung et al. | 15/151 |
| 3,457,581 | 7/1969 | Oas | 15/147 |
| 3,512,203 | 5/1970 | McClellan, Jr. | 15/229 |
| 3,605,161 | 9/1971 | Moss et al. | 15/150 |
| 3,651,533 | 3/1972 | Bouras | 15/229 |
| 3,763,517 | 10/1973 | Moss | 15/229 |
| 4,114,224 | 9/1978 | Disko | 15/229 |
| 4,245,368 | 1/1981 | Cotey et al. | 15/229 |

*Primary Examiner*—Edward L. Roberts

*Attorney, Agent, or Firm*—Robert M. Isackson; Robert R. Jackson

[57] ABSTRACT

A replaceable plastic mophead having means for attaching the mophead to a mophandle and securing water-absorbent mop material between two separately molded plates of a plastic material wherein the inner surface of each plate has a plurality of relatively uniform fingers projecting therefrom and the inner surface of one plate or the other has several spacers for securing the plates together a fixed distance apart such that when the two plates are secured together, the opposing fingers penetrate and displace local areas of the interposed mop material, substantially preventing any mop material from being pulled out of the mophead.

13 Claims, 5 Drawing Figures

REPLACEABLE PLASTIC MOPHEAD

BACKGROUND OF THE INVENTION

This invention relates to mops, and in particular to replaceable mopheads having a plurality of strands of water-absorbent mop material.

One problem with conventional mopheads having a plurality or bundle of strands is that unless the strands are securely fastened together, and to the mop, individual strands may be pulled from the bundle during use.

Mopheads utilizing various means for securing the strands together have been developed. In one known mophead construction—exemplified by Toplitz U.S. Pat. No. 1,701,167—the bundle of strands is surrounded by a strip of web material, such as canvas, and the web material and strands are stitched together. While this construction has had considerable success, it necessitates a costly manufacturing step requiring labor, time, floor space, and stitching machinery. Further, if every strand is not stitched, or if the stitching fails, strands can be pulled out during use.

Other known mopheads rely, at least in part, on using great pressure to permanently attach the strands together. The mop strands, for example, may be clamped between a rigid plate and a bale wire as shown in McClung et al. U.S. Pat. No. 3,447,183. Alternatively, as shown in Bundenthal et al. U.S. Pat. No. 2,159,350, the strands may be secured between two channel-shaped jaw members wherein two U-shaped prongs, made of spring wire, are riveted to the first jaw. The prongs' legs project through slots in the first jaw and through corresponding slots in the second jaw. While the jaws are pressed together under great force, the legs are folded over to secure the mop strands between the jaws.

As a further alternative, exemplified by Sellesi U.S. Pat. No. 3,328,822, the strands may be secured between two plates. The first plate may have attached a plurality of rigid cylinders. Each cylinder has a tip of diameter greater than both the diameter of the cylinder and the diameter of a corresponding hole in the second plate. Each tip is forced through the corresponding hole such that the tips overlap the backside of the second plate and thus prevent the prongs from withdrawing from the holes. This secures the two plates together with the mop strands therebetween.

Another known mophead, shown in Martin U.S. Pat. No. 2,492,232, combines the use of the stitched web and pressure by clamping the strands about the webbed section between a bale and a plate. While this construction allows for replaceability of the mop strands, it does not adequately solve the problem of securely fastening the strands at a low cost.

Another mophead known in the art (see McClellan U.S. Pat. No. 3,512,203) is formed by injecting a plastic material into a mold in which the strands have been inserted. The plastic completely penetrates the strands and forms a water impervious barrier about the mid portion of the strands.

Yet another known mophead (see Disko U.S. Pat. No. 4,114,224) uses a nonwoven web of material rather than fibrous strands. The material has holes cut in it to fit over or about a central post for holding the material in place.

Except for mopheads having stitched webbing, the securing means must exert great clamping pressure on the strands either while the strands are being affixed in place, or continuously in order to keep the strands in place, or both. Conventional mopheads having metal pieces suffer the risk that those pieces with which the strands are mechanically connected may weaken significantly over time and with repeated use. Further, the metal construction may scratch floors or damage furniture, and also has a tendency to corrode, which accelerates the effects of wear. Other mopheads constructions require injection of plastic under considerable pressure into the strands within special insert molding equipment.

None of the above-mentioned mophead constructions can be made utilizing the low-cost, high-production-rate techniques necessary to produce disposable mopheads which will perform as well as, if not superior to, any mops not having replaceable mopheads, or any mops having replaceable strands.

It is therefore an object of this invention to provide a disposable mophead which is relatively inexpensive to manufacture and superior in performance, and in which the water-absorbent material is securely held together by relatively small mechanical forces.

It is another object of this invention to provide a throw-away plastic mophead which permanently secures water-absorbent material without the need for excessive initial or continuous clamping pressure.

SUMMARY OF THE INVENTION

In a preferred embodiment, the invention comprises means for securing together a plurality of water-absorbent members, preferably mop strands, between two rigid elements. The mop strands typically are a cylindrical flexible fibrous material of substantially uniform diameter having a plurality of yarns in a spiral arrangement. Each yarn typically has a plurality of fibrous absorbent threads which also may be arranged spirally. Each rigid element is preferably a rectangular plate of molded plastic material having a plurality of substantially uniform fingers protruding from the inside surface. When the mop strands are placed between the two rigid elements, and the elements are pressed together, the opposing fingers on the inside surfaces penetrate the strands. This penetration causes local displacements—vertical, horizontal, or both—of the fibrous threads of each strand, thereby deforming the otherwise uniform spiral arrangement of the yarns and the mop strands.

It is contemplated that the fingers may be constructed having dimensions appropriate to penetrate individual yarns, causing local displacements of individual threads of any yarn, as well as the yarn itself. For purposes of illustration, however, the discussion will refer only to the fingers penetrating mop strands and causing local displacement of the yarns.

The two rigid elements are positioned so that the fingers are opposing and interfit, and so that the fingers do not contact each other. The rigid elements are secured to each other with a substantially uniform, fixed distance between them. This fixed distance is preferably less than or equal to the sum of the length of one top finger plus the length of one bottom finger plus the average diameter of the mop strands to be secured. Fixing the distance between the ends of the opposing fingers at or less than one strand diameter assures that at most only the few strands equidistant to the nonoverlapping free ends of the opposing fingers will not have direct finger penetration. More preferably, the fixed distance between the rigid elements is equal to or less than the sum of the length of one top finger and one bottom finger. The minimum spacing between the rigid elements is the length of the longest top or bottom finger. The distance between the rigid elements is maintained by spacers which also serve as connecting means securing the members together. Preferably the spacers are molded as a part of one rigid member or the other, and ultrasonically welded to the other. However, any form of permanent fastening can be employed.

The interfitting of the fingers and the separation of individual yarns from the strands distributes the yarns around and about the fingers so that the yarns follow a tortuous path through the fingers. This tortuous path applies significant lateral mechanical forces to the strands both individually and jointly. Any attempt to pull out an individual strand is effectively an attempt to unravel the yarns of the strand which is resisted by:

(1) the presence of the fingers directly in the way and the reactive force exerted by the fingers opposite to the pulling force;

(2) the mechanical pressure exerted by the rigid elements on the gathered strands when secured together to keep the fingers in and among the strands; and (3) the frictional forces of one strand against the yarns of neighboring strands which are wedged in between yarns from other strands and various fingers.

Even strands not having direct finger penetration are sufficiently held in place against attempted extraction by the lateral mechanical and frictional forces exerted by adjacent strands having direct finger penetration.

The rigid elements are preferably separately molded. One element is the top plate and preferably has, integrally molded on its non-finger side, means for attaching a mophead to a mop handle. Such means may include, for example, a female threaded passageway. Further, the top plate may also have side walls, or a skirt, projecting from the edges of the top plate downward, in the direction of the fingers. The projection or "length" of the skirt may be long enough, first, to conceal the second element or bottom plate from view after the two plates are fastened together, providing a pleasant aesthetic appearance; second, to keep objects from wedging between and separating the two plates; and third, to direct the mop strands downward into a group, thereby maximizing the surface area of the plurality of strands in contact with the floor to be cleaned during use.

Further features of the invention, its nature and various advantages will be more apparent from the accompanying drawing and the following detailed description of the invention.

DETAILED DESCRIPTION OF THE INVENTION

Figure 1:
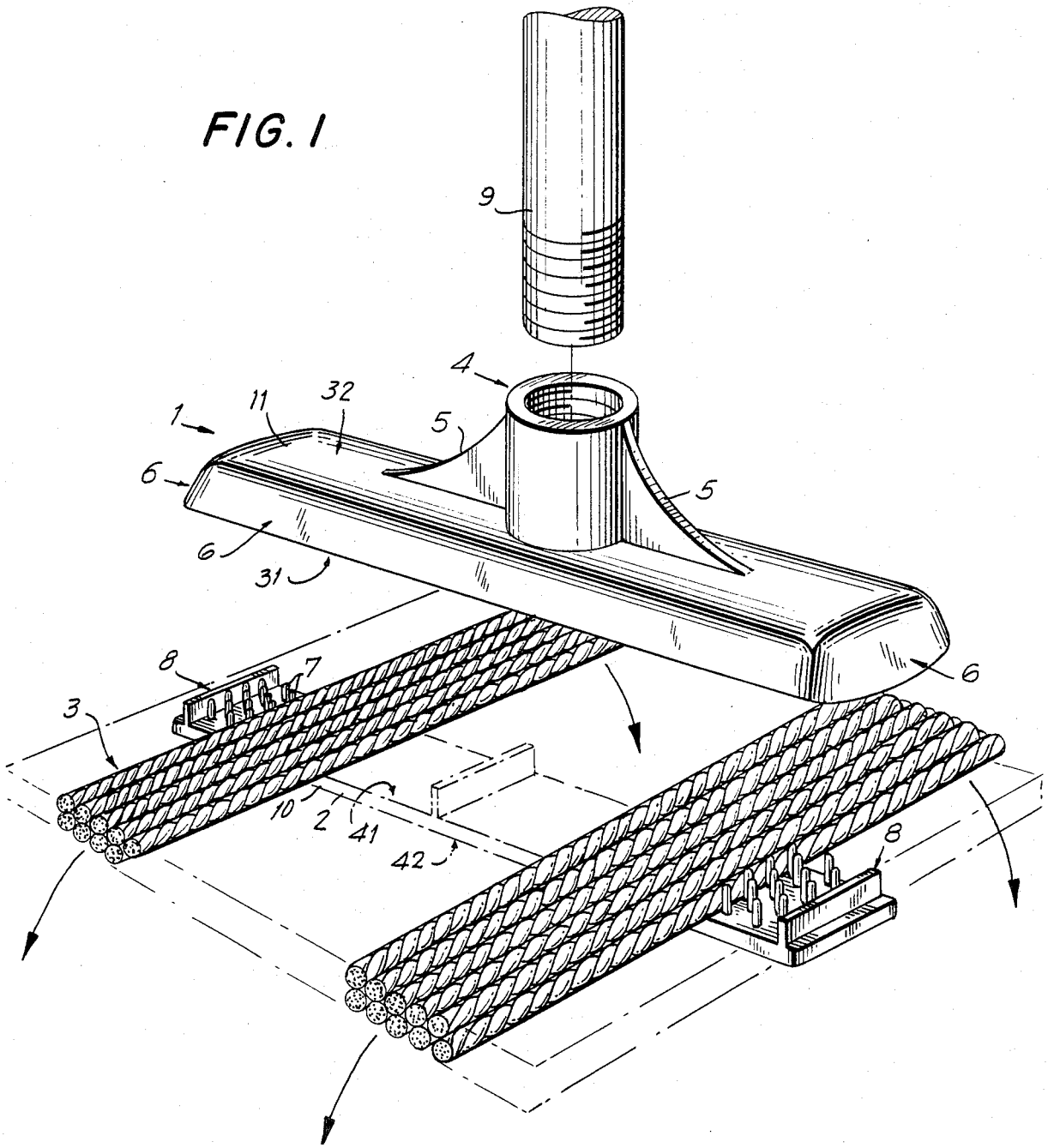
FIG. 1 is an exploded perspective view of an illustrative embodiment of the mophead of this invention.
Figure 2:
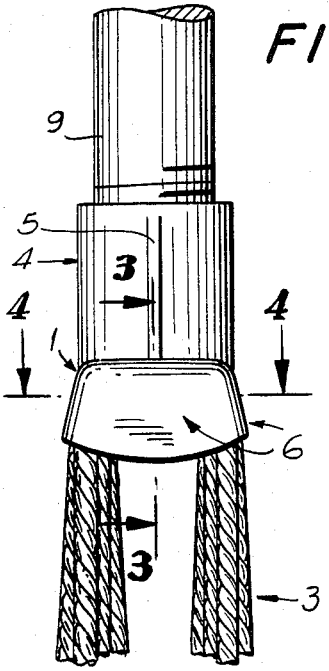
FIG. 2 is a side view of the mophead of FIG. 1.

As shown in FIGS. 1 and 2, an illustrative embodiment of the mophead of this invention comprises cover plate 1 and bottom plate 2 which are joined together and which have mop strands 3 substantially uniformly dispersed along and between plates 1 and 2. Cover plate 1 is a single molded piece of plastic material having inner side 31, outer side 32, and base 11. On outer side 32 are supports 5 and a female threaded passageway 4 capable of receiving male threaded mop handle 9. Attached to base 11 are side walls or skirt 6 which direct the strands into a group away from outer side 32. Projecting from base 11 is a plurality of substantially uniform top fingers 12 arranged in spaced rows and columns (FIGS. 3–5).

Bottom plate 2 is also a single molded piece having inner side 41, outer side 42 and base 10. Projecting from base 10 is a plurality of substantially uniform bottom fingers 7 arranged in spaced rows and columns, and at least two spacers 8. Spacers 8, protruding from bottom plate 2, are connected to inner side 31 of cover plate 1 by ultrasonic welding, gluing, or otherwise, to secure bottom plate 2 and cover plate 1 together, a fixed distance apart.

The water-absorbent members or mop material comprises a plurality of strands 3. Each strand 3 is made up of a plurality of spirally interrelated yarns 14. Each yarn is made up of fibrous water-absorbing threads which are also spirally interrelated. The strands are distributed along and between cover plate 1 and bottom plate 2 before plates 1 and 2 are secured together.

Figure 3:
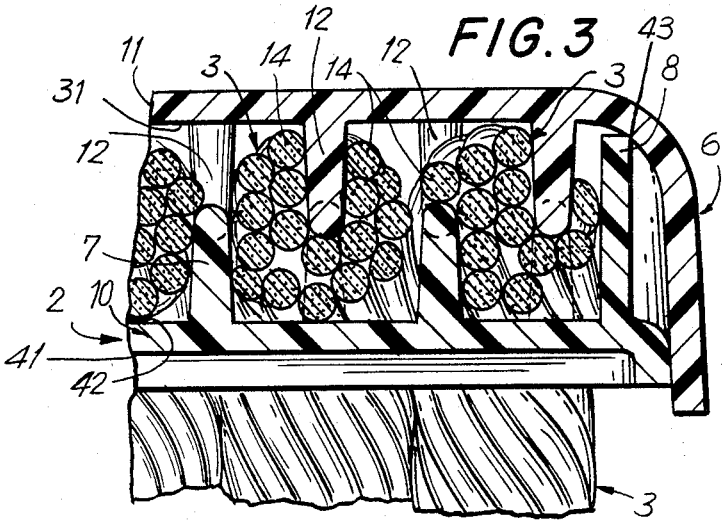
FIG. 3 is a partial cross sectional view taken along line 3—3 of FIG. 2.
Figure 4:
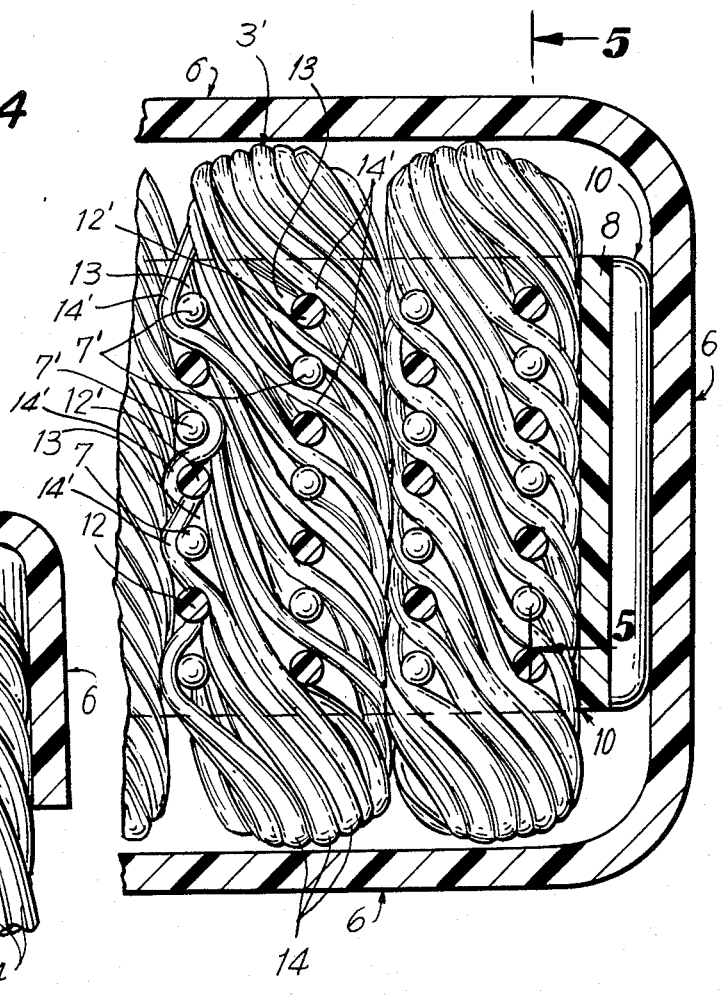
FIG. 4 is a partial cross sectional view, taken along line 4—4 in FIG. 2.
Figure 5:
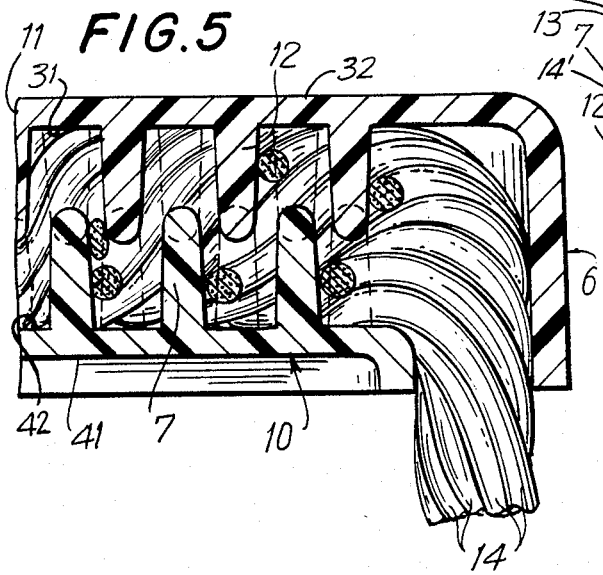
FIG. 5 is a partial cross sectional view taken along line 5—5 in FIG. 4.

FIGS. 3–5 show how top fingers 12 and bottom fingers 7 are arranged in an interdigitated relationship, i.e., the free ends of fingers 7 and 12 overlap but do not touch one another. When elements 1 and 2 are secured together, fingers 7 and 12 are directed towards each other and collectively pierce every strand. To assure that every strand is pierced by at least some fingers, the distance between adjacent fingers 7, measured perpendicularly to the longitudinal axis of strands 3, is preferably less than the average diameter of strands 3. Adjacent fingers 12 are similarly spaced. For purposes of illustration, only one layer of strands is shown. It is to be understood, however, that the dimensions and arrangement of the fingers may allow for placement of several layers of strands, aligned or randomly arranged, between cover plate 1 and bottom plate 2. Any pattern of finger placement may be used as long as the top and bottom fingers provide adequate penetration to pierce and hold the strands according to this invention.

FIGS. 3 and 4 show how top fingers 12 and bottom fingers 7 pierce the strands in different local areas. Fingers 7 and 12 penetrate each strand and separate the yarns of that strand. For example, as shown in FIG. 4, when the strands are pierced by fingers 7' or 12', yarns 14' are displaced laterally, or vertically, or both, at local areas 13. Local areas 13 are indicated in FIG. 4 as gaps adjacent the fingers for illustrative purposes. Preferably, the flexible yarns 14 are displaced around the fingers so that when the top and bottom plates are secured together, no significant gaps exist. When fingers 7 or 12 are inserted interior to strand 3', lateral forces are exerted on one or more yarns 14 of strand 3'.

These forces displace the yarns and causes at least some of yarns 14 to follow tortuous paths.

Yarns 14 are arranged spirally to create a single strand 3', and preferably each strand is pierced by at least one and preferably more than one finger 7' or 12'. Any attempt to remove one strand would require that the strand, having fingers 7' or 12' interposed at local areas 13 along the strand, be unraveled. Fingers 7 or 12 except lateral forces at local areas 13, compressing and dislocating yarns 14'. The lateral pressures, the resistance of the fingers, and the lateral frictional forces of neighboring yarns and strands on the strand being pulled, act cumulatively to hold the strand in place. In use, fingers 7 or 12 permanently secure strands 3 in place. Removal of one strand would require overcoming the substantial resistance created by the finger-plate configuration.

Referring now to FIG. 3, it is shown how spacers 8, integrally molded with and projecting outwardly from inner side 41, are secured to inner side 31 of cover plate 1 at local area 43, such that enough strands 3 are captured between cover base 11 and bottom base 10 to achieve the desired piercing of strands 3 by fingers 7 or 12. Mechanical forces are temporarily applied to cause the fingers to penetrate strands 3 and to hold cover plate 1 and bottom plate 2 in place while spacers 8 are secured to inner side 31 at area 43.

As various changes can be made in the above constructions without departing from the scope of the invention, it is intended that all matter contained in the above description or shown in the accompanying drawings shall be interpreted as illustrative and not in a limiting sense.

I claim:

1. A mophead comprising:

a first element having a rigid base and a plurality of substantially uniform fingers, the fingers being spaced apart in two dimensions along and projecting from one side of the base in a first spaced relationship, the distance between two adjacent fingers measured perpendicular to the longitudinal axis of a predetermined size mopstrand being less than the diameter of a mopstrand;

a second element having a rigid base and a plurality of substantially uniform fingers, the fingers being spaced apart in two dimensions along and projecting from one side of the base in a second spaced relationship, the distance between two adjacent fingers measured perpendicular to the longitudinal axis of a predetermined size mopstrand being less than the diameter of a mopstrand;

a water-absorbent mop material comprising a plurality of individual strands substantially uniformly dispersed along and between the first and second elements wherein each strand has a diameter greater than the distance between two adjacent fingers; and a first means for permanently securing the first and second elements together and for securing the water absorbent mop material between the first and second elements, wherein the first spaced relationship corresponds to the second spaced relationship so that the fingers of the first and second elements project in opposition, and collectively contact, penetrate, and displace local areas of the individual strands of water-absorbent mop material adjacent each finger penetration to provide substantially the sole means for holding the strands together and in the mophead and for preventing any strand from being pulled out of the mophead.

2. The mophead defined in claim 1 wherein the fingers in the first spaced relationship are arranged in rows and columns, and wherein the second spaced relationship corresponds to the first spaced relationship so that, when the first and second elements are secured together, the opposing fingers are not in contact and the distance between the first base and the second base is equal to or less than the sum of the length of one of the first element's fingers and the length of one of the second element's fingers.

3. The mophead defined in claim 1, wherein the water-absorbent mop material comprises a plurality of individual strands of relatively uniform diameter, each strand including a plurality of yarns arranged in a spiral relationship, each yarn including a plurality of fibrous threads.

4. The mophead defined in claim 3 wherein the fingers in the first spaced relationship are arranged in rows and columns, and wherein the second spaced relationship corresponds to the first spaced relationship so that, when the first and second elements are secured together, the opposing fingers are not in contact and the distance between the first base and the second base is less than or equal to the sum of the length of one of the first element's fingers plus the length of one of the second element's fingers plus the average diameter of a mop strand.

5. The mophead defined in claim 1, the first element further comprising:

a second means, attached to the side of the base not having fingers projecting therefrom, for securing the mophead to a mop handle.

6. A mophead comprising:

a first element having a rigid first base and a plurality of substantially uniform fingers projecting from one side of the first base in a first spaced relationship;

a second element having a rigid second base, a plurality of substantially uniform fingers projecting from one side of the second base in a second spaced relationship, a mounting means, attached to the side of the second base not having fingers projecting therefrom, for securing the mophead to a mop handle, and an annular skirt projecting from the periphery of the second base in the same direction as the associated fingers, the second base and skirt forming a concavity opening away from the mounting means, the skirt projecting from the second base by a distance greater than the distance between the first and second bases when the first and second elements are permanently secured together so that the first element is substantially within the concavity;

a water-absorbent mop material, substantially uniformly dispersed along and between the first and second elements; and a first means for permanently securing the first and second elements together and for securing the water-absorbent mop material between the first and second elements, so that the fingers of the first and second elements project in opposition, and contact, penetrate, and displace local areas of the water-absorbent mop material adjacent each finger penetration, the concavity formed by the skirt and the second base directing the water-absorbent materials away from the mounting means.

7. The mophead defined in claim 6, the first element further comprising one piece of a molded plastic material.

8. A mophead comprising:

a plurality of laterally adjacent strands of mop material, each strand having a relatively uniform diameter and being made up of a plurality of yarns twisted together;

first and second laterally spaced, substantially parallel, rigid members disposed on respective opposite sides of the strands of mop material, each member having a plurality of fingers projecting from the surface of the member toward the other member so that each strand of mop material is penetrated by at least one finger to substantially prevent any strand from being pulled out of the mophead, the first member having a peripheral skirt parallel to the fingers and extending from the first member toward the second member so that the periphery of the second member is substantially surrounded by the skirt; and means for holding the first and second members together.

9. The mophead defined in claim 8 wherein the means for holding the first and second members together comprises a plurality of spacer members substantially parallel to the fingers, each spacer member being fastened to the first member and fastened to the second member.

10. The mophead defined in claim 8 wherein the means for holding the first and second members together comprises a plurality of spacer members substantially parallel to the fingers, each spacer member being unitary with one of the first and second members and fastened to the other of the first and second members.

11. The mophead defined in claim 8 wherein the first and second members and the fingers are made of plastic material.

12. The mophead defined in claim 8 wherein the strands of mop material project from the first and second members via a clearance between the skirt and the periphery of the second member.

13. The mophead defined in claim 12 further comprising means on the side of the first member remote from the second member for attaching the mophead to a handle.

* * * * *